United States Patent [19]

Morarka et al.

[11] Patent Number: 4,650,354

[45] Date of Patent: Mar. 17, 1987

[54] BI-LEVEL CARTRIDGE WITH DUAL DRIVES FOR ENDLESS RIBBON

[75] Inventors: Kedar M. Morarka, Mitchellville; James A. Jones, II, Des Moines, both of Iowa

[73] Assignee: Frye Copysystems, Inc., Des Moines, Iowa

[21] Appl. No.: 782,326

[22] Filed: Oct. 1, 1985

[51] Int. Cl.[4] ..... B41J 32/02

[52] U.S. Cl. ..... 400/196.1; 400/208; 226/118

[58] Field of Search ..... 400/194, 195, 196, 196.1, 400/207, 208, 208.1; 226/118, 119; 242/194, 55.19 A

[56] References Cited

U.S. PATENT DOCUMENTS 3,618,841 11/1971 Browning ..... 242/55.19 A X
3,830,351 8/1974 Cappotto ..... 400/208
3,980,171 9/1976 Frechette ..... 400/208
4,140,407 2/1979 Porterfield et al. ..... 400/208 X
4,467,976 8/1984 Bogaczyk et al. ..... 242/194 X
4,595,305 6/1986 McGourty et al. ..... 400/208

*Primary Examiner*—Charles A. Pearson
*Attorney, Agent, or Firm*—Patrick L. Henry; Barry L. Clark

[57] ABSTRACT

Bi-level cartridge for an endless printer ribbon has superposed upper and lower compartments with a ribbon stuffing feed means located in each compartment. The ribbon is guided so that it travels once through each of the compartments for each pass that it makes past a printing station. The feed means for each compartment are coaxial and keyed together so they can be driven by the printer's drive member. To facilitate threading and stuffing of the cartridge, an idler roller portion for one of the feed means is selectively movable into or out of biased engagement with its driven roller portion.

4 Claims, 4 Drawing Figures

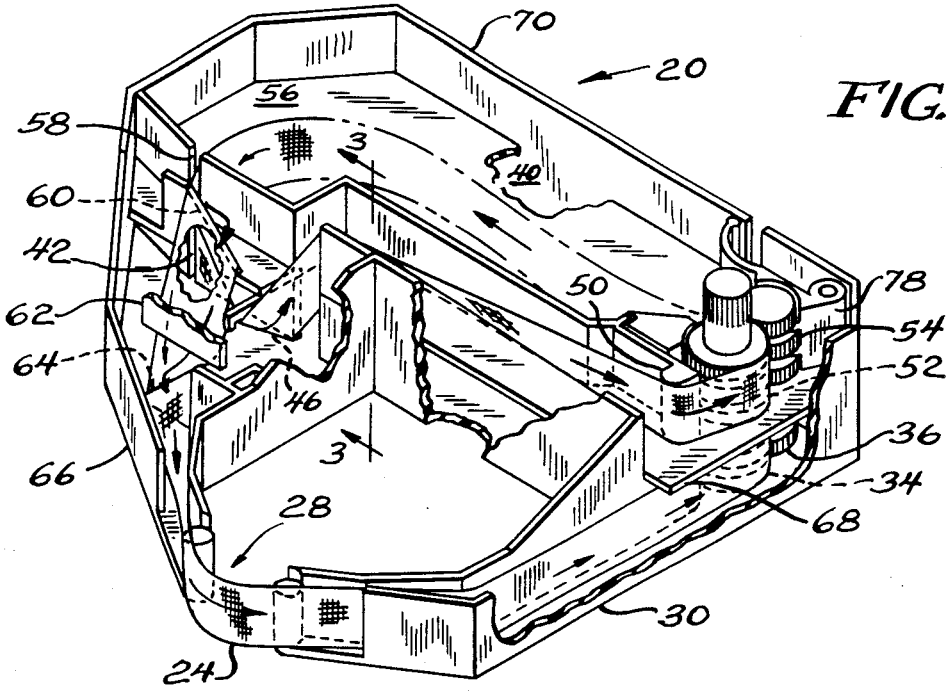
FIG. 1
FIG. 3
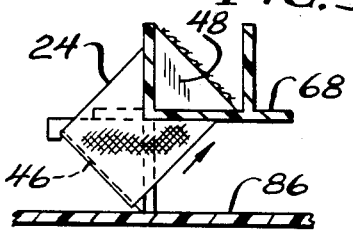
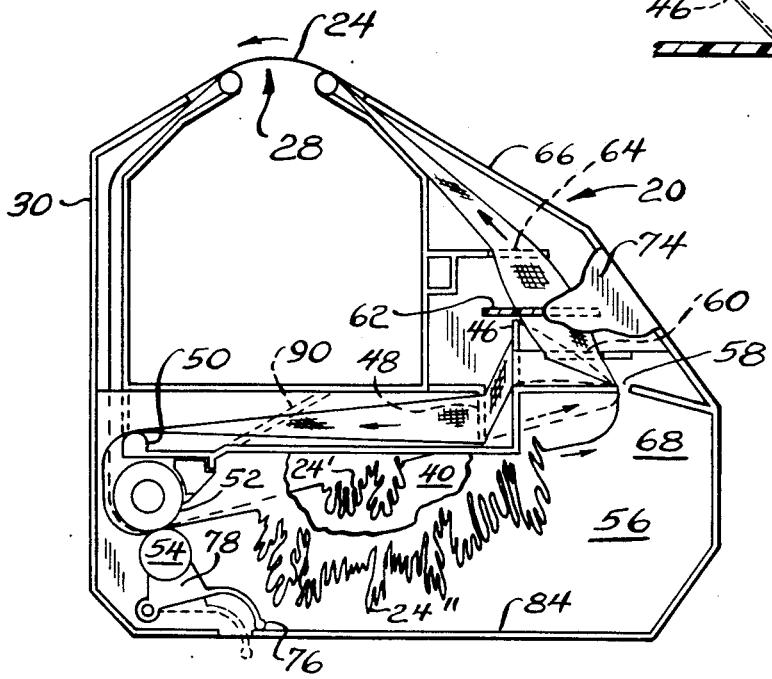
FIG. 2

BI-LEVEL CARTRIDGE WITH DUAL DRIVES FOR ENDLESS RIBBON

BACKGROUND OF THE INVENTION

The invention relates to printing ribbons and particularly to endless ribbons of the type which are made of a fabric which has been impregnated with ink and stuffed into a disposable cartridge. Typically, the cartridge is adapted to be used in a dot matrix type of printer which has a drive shaft which engages a feed mechanism in the cartridge for pulling ribbon into one end of the cartridge after it has been engaged by the printer's print head. Due to space limitations, the volume of space available inside the cartridge for the stuffing of ribbon is generally quite limited and some cartridges can contain no more than about 30 feet of ribbon. For example, for one particular cartridge having a ribbon length of 32 feet, it can be calculated that about 17,400 characters can be printed for each pass of the ribbon past the print head. For a ribbon having a total ribbon life of 3 million characters, this would be about 172 passes. When the printer is printing continuously for long periods, it is obvious that the ribbon of the example could start to recycle after just 8 or 9 pages had been printed. In such a printing situation, one might notice that the characters are darker at the beginning of printing and lighter after the ribbon has been cycled once. This is a result of the fact that it takes a considerable time for ink in the ribbon to flow to a just used spot. It is known that the longer the ribbon, and thus, the longer the time available for ink to flow, the more uniform will be the density of the printed characters. The ribbon life will also be longer. Furthermore, it is known that the increase in ribbon life is not directly proportional to the increase in ribbon length since doubling the length of a ribbon should more than double the number of satisfactory characters it can print.

SUMMARY OF THE INVENTION

It is among the objects of the present invention to provide a cartridge for endless fabric ribbon which can contain about double the length of ribbon previously contained. It is another object of the present invention to provide a cartridge which can substantially more than double the number of satisfactory characters produced by a cartridge used on a particular printer. Yet another object is to provide an endless type fabric ribbon cartridge which can hold twice the ribbon of a conventional cartridge but which can be manufactured for considerably less than twice the cost of a conventional cartridge.

The foregoing and other objects and advantages are attained by the cartridge of the present invention which can generally be described as a bi-level cartridge. The lower level is generally conventional in that it has a pair of extending arms that provide a guide path for moving the ribbon through a printing station and past a print head on the printer. It also contains a lower ribbon feeding mechanism, typically including a serrated feed roller and a complementary spring biased idler roller. The feed roller is adapted to be engaged and rotated by a drive shaft in the printer. A lower ribbon compartment is located downstream of the lower ribbon feeding mechanism and is adapted to receive a large supply of ribbon which is stuffed therein in a zigzag or pleated fashion by the lower feed mechanism. The ribbon leaves the lower compartment through a vertical slot in the front wall thereof near the end of the compartment which is most distant from the lower feed mechanism. It is then directed. over a pair of angled guides which direct it upwardly toward and into an upper ribbon compartment where it is engaged by an upper ribbon feeding mechanism. The upper feeding mechanism is preferably identical to the lower one with the upper feed roller being integral with or keyed to the lower feed roller so as to drive the ribbon at the same speed. A vertical slot in the front wall of the second compartment near its exit end directs the ribbon out of the second compartment and toward a pair of angled guides which bring it down to the lower level of the cartridge, out of the arm on the upstream side of the printing station and into the printing station where it begins another cycle of movement. To further increase the life of the ribbon, the aforesaid pair of angled guides in the upstream arm are located so as to cooperate with a rib in the cartridge cover to turn the ribbon over so that it will print on its opposite side surface and in a path adjacent a different side edge of the ribbon on each successive pass through the cartridge. The last mentioned arrangement is quite conventional and requires that the ends of the ribbon be joined together in a "mobius loop" wherein the ribbon is given a single twist so that the front face of one end of the ribbon is butt welded to the rear face of the other end.

BRIEF DESCRIPTION OF THE DRAWINGS

FIG. 1 is a partially broken away isometric view of the improved bi-level cartridge with its top cover removed for clarity;

FIG. 2 is a top plan view of the cartridge of FIG. 1 with portions broken away and all except a small portion of the top cover removed for clarity;

FIG. 3 is a vertical section view taken on line 3—3 of FIG. 1; and

DETAILED DESCRIPTION

Figure 4:
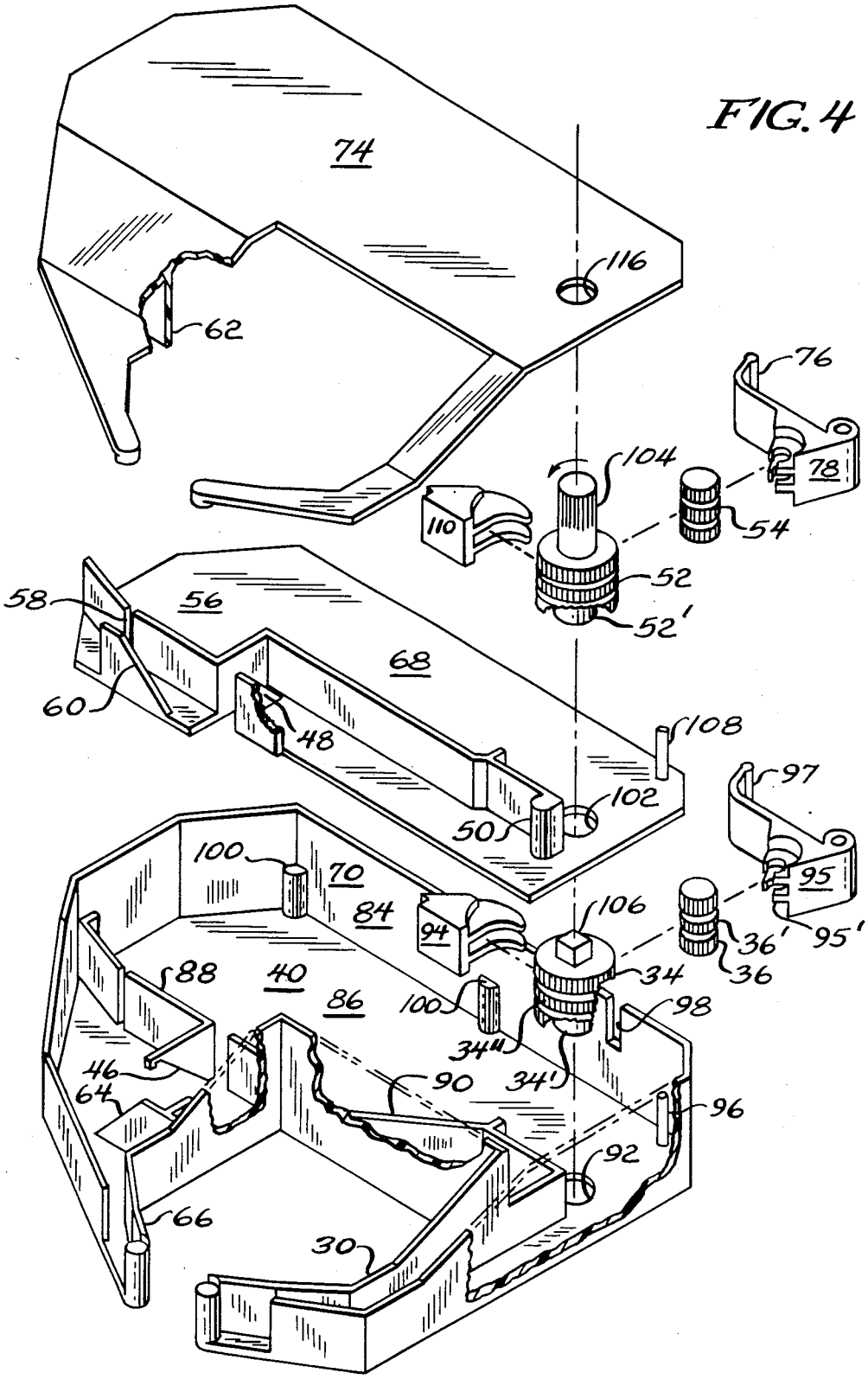
FIG. 4 is an exploded isometric view of the parts of the cartridge of FIG. 1 and its cover, with the ribbon removed for clarity.

Referring to FIG. 1, one can see, by following the arrows, the successive positions within the cartridge 20 which the ribbon 24 assumes. As the ribbon leaves the print station 28 wherein it is adapted to be engaged by a print head, not shown, it enters the inlet arm 30 and passes between a lower serrated or toothed drive roller 34 and a lower serrated or toothed idler roller 36 which comprise a lower feeding mechanism. The ribbon is vertically pleated or creased by the serrated rollers 34, 36 and caused to be folded back and forth on itself in hundreds of tiny loops 24' (FIG. 2) which fill the lower compartment 40. The ribbon exits compartment 40 through vertical slot 42. The ribbon then has its plane shifted 45° by the angled bracket 46 which directs it angularly upwardly into contact with another angled bracket 48, best seen in FIGS. 3 and 4, which permits the ribbon to return to a vertical plane as it passes a guide 50 and then passes between upper serrated drive roller 52 and upper idler roller 54. The rollers 52, 54 comprise an upper feeding mechanism that forms small pleats or loops 24" (FIG. 2) in the ribbon as it feeds the ribbon into and through the upper compartment 56. For clarity, the loops have been omitted except in FIG. 2. The ribbon exits the upper compartment through slot 58 and then gets completely turned over as it passes over the top edge of angled bracket 60, under the rib 62 which is on the cover 74 (FIG. 4) and then over the top edge of angled bracket 64. The ribbon then exits the outlet arm 66 and enters the printing station 28.

The operation of stuffing the bi-level cartridge 20 can also be generally explained by reference to FIG. 1. One end of the ribbon 24, attached to a supply roll (not shown), is threaded straight through the entire path indicated by the arrows as hereinbefore described. During this initial threading operation, the upper idler 54 is positioned so as to be out of engagement with the upper drive roller 52. The free leading end of the ribbon is then retained at the print station 28 while the lower and upper compartments 40, 56 are sequentially stuffed as will be hereinafter explained. Finally, when the cartridge is full, the ribbon is cut from its supply roll and the cut end is attached, such as by sonic welding, to the free leading end. In more detail, before the center tray element 68 is assembled to cover the lower compartment 40, the ribbon 24 is initially threaded through the exposed lower compartment 40 and brought out of slot 42. The center tray element 68 is then dropped into the cartridge where it will cover the lower compartment 40 and cooperate with the upper portions of the outer casing 70 to form the upper compartment 56. The ribbon can then be threaded from slot 42 through the remainder of its path until its free end is at print station 28. At this point, the cover member 74 (FIG. 4) can be assembled. Stuffing is commenced by actuating a drive (not shown) to rotate the drive roller 34, which is in spring biased engagement with the lower idler. A predetermined amount of ribbon, such as 32 feet, for example, is then pulled off the supply by the rotation of drive roller 34 and is stuffed into compartment 40. At this point, the upper idler 54 is brought into engagement with upper drive roller 52 by pressing in the tip end 76 of its idler support bracket 78 (FIG. 2) from its dotted line position to its solid line position. The drive rollers 34 and 52 are then simultaneously rotated until another 32 feet of ribbon is pulled off the supply. Since the upper idler 54 is now in mesh with the upper drive roller 52, the 32 feet of ribbon that was stuffed in the lower compartment will be pulled from the lower compartment 40 into the upper compartment 56 and a second 32 feet will be stuffed into the lower compartment from the supply. At this point, the ribbon is cut off from its supply and the cut trailing end is welded to the free leading end that was previouslY retained at print station 28.

The just described stuffing method requires that the various parts of the cartridge 20 be assembled as the ribbon 24 is being stuffed. An alternative procedure would be to thread a leader ribbon (not shown) into the cartridge as the cartridge is assembled and then to use the leader to pull the ribbon to be stuffed. Even in this alternative method, the upper idler 54 would remain disengaged from contact with the drive roller 52 until the lower compartment 40 had been stuffed. Then, after the upper idler 54 is engaged and the top compartment 56 is stuffed, the leader is withdrawn until the leading end of the ribbon 24 reaches the print station 28 where it is welded to its opposite or trailing end which was cut off from the supply roll.

FIG. 2 is a top plan view of the cartridge 20 with all except a small portion of its top cover removed and with a portion of the tray element 68 broken away to expose a portion of the lower compartment 40. The view gives a little different perspective of the relationship between the ribbon 24 and the various parts of the cartridge than that provided by FIG. 1 so the ribbon path will again be explained. Proceeding counterclockwise from the printing station 28, the ribbon 24 will first pass into and through the inlet arm 30 and will enter the lower compartment 40 in the nip of the driven roller 34 (FIG. 1) and the idler roller 36. For simplicity, the ribbon's path through the lower compartment 40 is mainly indicated as a relatively straight dotted line between the rollers 34, 36 and the vertical exit slot 42 (FIG. 1). However, the ribbon is actually pleated or creased by the serrations or teeth on the rollers to produce hundreds of tiny loops such as those shown at 24'. This pleating permits almost 100 times the straight line ribbon length to be stuffed in the compartment 40. The ribbon leaves the lower compartment in a vertical plane but gets tilted at a 45° angle by lower bracket 46 which then directs it upwardly to upper bracket 48. The ribbon then passes around guide 50 and enters the nip of the upper serrated rollers 52, 54 which pleat it and stuff it into the upper compartment 56, as indicated at 24''. The ribbon leaves the upper compartment 56 in a vertical plane through vertical slot 58 but then is provided with the 180° twist required for its mobius loop by being passed first over angled bracket 60, then under the horizontal rib 62 which extends downwardly from the cover 74 and finally, over the top of angled bracket 64. The ribbon then passes through the outlet arm 66 to the printing station 28.

FIG. 3 is a vertical section view taken on line 3—3 of FIG. 1 which illustrates how the ribbon 24 is guided by angled brackets 46, 48 during the course of its movement from the lower compartment 40 to the upper compartment 56.

FIG. 4 is an exploded view of the various parts, preferably molded of plastic, which, when assembled together and loaded with a ribbon 24, produce a finished bi-level cartridge 20. The main casing or body member 70 has a vertical outer wall portion 84, a floor portion 86, and vertical inner wall portions 88, 90 which generally define the lower ribbon compartment 40. An aperture 92 supports a cylindrical hub portion 34' on the bottom of feed roller 34 and permits the roller 34 to rotate when a downwardly extending splined socket (not shown) within the hub portion is engaged by an external drive member (not shown). The serrations or teeth 34'' on the drive roller 34 are designed to cooperate with complementary serrations or teeth 36' on the idler roller 36 to pleat a ribbon and stuff it into the compartment 40 as shown at 24' in FIG. 2. To prevent the ribbon from wrapping around the roller 34, a blocking member 94 is positioned adjacent the roller 34. The idler roller 36 is snapped into and supported by finger portions 95' of the pivoted support member 95. The support member 95 is pivotally mounted on pivot pin 96. Its outer tip 97 is adapted to contact the wall 84 to produce a resilient biasing foroe between the idler roller 36 and the feed roller 34.

A tray-like element 68 forms the top surface for the lower compartment 40 and the bottom surface or floor of the upper compartment 56. It rests on molded projections 100 and on the upper surfaces of the inner wall portions 88, 90. An aperture 102 forms a bearing surface for the hub portion 52' of the upper drive roller 52. To permit the transfer of rotary motion of the lower roller 34 to the upper roller 52, or vice versa when the manually rotatable knob portion 104 is engaged, the lower roller 34 is shown as including a non-circular projection 106 which is adapted to be engaged with a complementary-shaped socket (not shown) in the bottom of roller 52. A vertically projecting pin 108 is provided for the same purpose as the lower pin 96 and the elements 54 and 78 each perform the same function as the identically shaped elements 36 and 95 in the lower compartment 40. An aperture 116 in the top cover member 74 permits the knob portion 104 of roller 52 to project above the cover. As previously discussed, the tip 76 of support member 78 is designed so as to be movable from its dotted line to its solid position shown in FIG. 2. Thus, by pressing in on the tip 76, the tip will snap through the slot 98 and rest on the inner wall 84. This movement will pivot the support member 78 and cause the idler roller 54 to be resiliently forced against the feed roller 52.

From the preceding description of a preferred embodiment of our bi-level cartridge invention, it will be readily obvious that the cartridge assembly 20 will permit about double the amount of a particular type of ribbon to be stuffed into its two compartments, as compared to conventional single level cartridges which have the same housing configuration. Obviously, the various shapes and locations of individual elements will change when the concept is adapated to other cartridge shapes.

We claim:

1. In a cartridge of the type in which an endless length of ribbon is adapted to be pulled through a space wherein it is adapted to be contacted by a printer head, said space being located between an exit aperture and an inlet aperture of the cartridge, by a first ribbon feed means which engages and stuffs the ribbon into a first compartment within the cartridge when actuated by a drive member with which the cartridge is adapted to be associated, the improvement comprising a second compartment superposed above the first compartment and separated vertically therefrom by a generally flat ribbon support surface; a second ribbon feed means which is adapted to be actuated when said first feed means is actuated to engage and stuff the ribbon into the second compartment; said second ribbon feed means being located within said second compartment, first compartment exit guide means and second compartment entrance guide means in said cartridge for guiding ribbon from said first compartment into said second compartment; said ribbon being adapted to be pulled past said first compartment exit guide means and said second compartment entrance guide means by said second ribbon feed means, and second compartment exit guide means for guiding ribbon from said second compartment toward the exit aperture of the cartridge.

2. A cartridge of the type described in claim 1 wherein the amount of ribbon stuffed into each of the first and second compartments is generally equal.

3. A cartridge of the type described in claim 1 wherein the first and second ribbon feed means are connected to each other.

4. A cartridge of the type described in claim 3 wherein the first and second ribbon feed means each include a serrated surface drive member.

* * * * *